United States Patent [19]

Gratsch

[11] Patent Number: 4,667,859

[45] Date of Patent: May 26, 1987

[54] DEVICE FOR FORMING A CONDENSED AREA ELIMINATING A DART OR A TUCK

[76] Inventor: Jack M. Gratsch, 6220 Britton Ave., Cincinnati, Ohio 45227

[21] Appl. No.: 822,634

[22] Filed: Jan. 27, 1986

[51] Int. Cl.[4] ..... D06C 15/00

[52] U.S. Cl. ..... 223/52; 26/18.5

[58] Field of Search ..... 223/1, 4, 28, 52; 26/18.1

[56] References Cited

U.S. PATENT DOCUMENTS

| | | | |
|---|---|---|---|
| 672,487 | 4/1901 | Menahan | 223/28 X |
| 873,179 | 12/1907 | Skinner | 223/52 |
| 1,042,715 | 10/1912 | Nirock | 223/28 |
| 1,209,904 | 12/1916 | Swartz | 223/28 |
| 1,733,353 | 10/1929 | Maulsby et al. | 223/28 |
| 3,336,644 | 8/1967 | Dusenbury | 26/18.6 |
| 3,467,290 | 9/1969 | Peacock | 223/52 |
| 4,324,004 | 4/1982 | Smith et al. | 223/4 |

*Primary Examiner*—Louis K. Rimrodt
*Attorney, Agent, or Firm*—Frost & Jacobs

[57] ABSTRACT

A cloth condensing unit is disclosed capable of forming a condensed portion of a piece of cloth, the condensed portion having a central area which is more condensed than the ends of the condensed portion, and a system for permanently maintaining the cloth in the condensed form. The cloth condensing unit can comprise different embodiments, for example, a plurality of spring loaded plates having a plurality of pins projecting vertically upward, wherein the plates are capable of being condensed in a vice. In another embodiment, the cloth condensing unit can consist of a rubber sponge having a gripping surface formed of embedded emery or a plurality of very small pins. When the surface is compressed into a specified area, the cloth positioned upon the surface of the semioval sponge is condensed. In another embodiment of the present invention, a semioval balloon-type device could be employed having an exterior gripping surface. When cloth is securely attached to the surface, and the balloon is deflated, the cloth will become condensed. A method for carrying out the operation of condensing the cloth is also disclosed.

9 Claims, 11 Drawing Figures

DEVICE FOR FORMING A CONDENSED AREA ELIMINATING A DART OR A TUCK

BACKGROUND OF THE INVENTION

1. Field of the Invention

The present invention relates to a method and apparatus for forming a condensed area in a suit jacket, for example. By using the device and method of the present invention, a garment maker can eliminate the need to fold or cut and stitch a tuck in an article of clothing as is conventionally known.

2. Prior Art

U.S. Pat. No. 1,042,715 to Mrock discloses a machine for shirring cloth or other material. The machine comprises a plurality of slide blocks placed in rows and columns. Each individual block includes an upwardly projecting needle securely mounted on the block. Each block is designed to slide upon a guide bar which in turn is directly coupled with a journaled shaft having a hand crank at one end thereof. By turning the hand crank, the series of blocks can be spaced from one another equidistantly. A piece of cloth is then placed upon the needles so that the needles project through the cloth. The hand crank is turned, moving all the blocks toward one another thereby compacting the material for puckering or shirring. Once the cloth has been puckered or shirred, a backing material is secured to the cloth by sewing, for example, so as to maintain the puckered or shirred design of the cloth.

U.S. Pat. No. 1,209,904 to Swartz discloses a device for making ornamental lining for receptacles. The device includes a plurality of elongated rectilinear bars having on each bar a plurality of pins such that the pins of one bar are offset with respect to the pins of an adjacent bar. A pair of journaled shafts are coupled to each end of each bar so that each bar can be spaced away from or positioned adjacent to the neighboring bars. In making the ornamental lining, a piece of fabric is positioned over the plurality of bars when the bars are spread apart the maximum distance permitted by the device. A plurality of weights are then employed to force the lining down over each pin thereby forming a plurality of pyramid shapes. The elongated bars are then forced toward one another to puff the cloth or lining. A backing material is then stitched to the cloth to maintain the puffed shape.

U.S. Pat. No. 1,733,353 to Maulsby et al discloses a device for forming a decorative design into fabric suitable for the lining of caskets and the like. This device includes a plurality of spaced apart blocks which are slidably mounted upon a plurality of elongated slide bars. At least some of the blocks have one or more pins secured thereto and projecting upwardly. Lastly, each elongated bar, which is arranged in parallel relationship on a frame to the remaining bars, may be adjusted away from or toward each other by a lazy tong mechanism. In using the device, the bars are moved or spaced apart, equally, the maximum distance permitted by the lazy tongs. A piece of cloth is positioned over the plurality of blocks and the pins project through the cloth or lining in order to hold the lining in position. The lazy tongs are then manipulated so that the plurality of bars are shifted toward one another thereby bringing the slide blocks toward one another to puff the material. Once the material has been puffed, a backing cloth is tacked by stitching to the puffed cloth so that the cloth will retain its shape when removed from the device.

While the above prior art devices disclose apparatus and method for forming ornamental cloth in a puffed or shirred fashion, these devices are not suitable for forming a condensed portion of cloth which will be smooth and sufficiently uniform to omit the necessity of forming a tuck in the conventional manner.

Accordingly, it is the primary aim of the present invention to eliminate the need for a conventional tuck created by folding or cutting and stitching two pieces of material to one another to thereby condense an area or portion of cloth and instead condense the area or portion of cloth by gathering the cloth in a plurality of small bunches, about $\frac{1}{8}$-inch, in a consistent manner and maintain the cloth in the condensed form.

SUMMARY OF THE INVENTION

The present invention is designed to replace the conventional tuck formed in a suit coat, for example, in which the cloth of the suit coat is cut or folded and stitched together to contract or condense that portion of cloth so that the suit coat will fit a person properly. The present invention forms a condensed area by gathering the material around the area where a tuck is conventionally positioned, for example, vertically along each rib cage, and applying an adhesive backing to the gathered cloth to retain the cloth in the gathered condition or state.

The device of the present invention comprises a plurality of elongated, rectilinear thin metallic plates oriented on edge and having a plurality of small diameter pins secured to the edge of each plate and projecting vertically upward. A plurality of plates are positioned adjacent one another with the outermost plates being bowed outwardly and with the centermost plate being generally straight. The plates positioned between the center plate and the outermost plate are progressively bent between the arc of the outermost plate and the generally straight centermost plate. The ends of each plate are secured in a frame. A cross-piece is positioned perpendicular to the centermost plate and includes a plurality of vertically oriented wedges which, when forced between the plurality of plates, provide clearance between each plate and limit the amount of contraction of the plate. Optionally, the wedges can be firmly positioned toward either end of the plurality of plates so that a non-symmetrical condensed area can be made. Lastly, a clamp in association with the frame is capable of clamping the plurality of plates together so as to condense the area covered by the plates and to condense any cloth skewered on the pins of the plates. The clamp forces the outermost plates having the largest arcuate curve toward the centermost plate until the plates are tightly clamped together, the spacing between each plate determined by the plurality of wedges.

In the preferred embodiment, the device is designed to be mounted on a hydraulic press so that ten layers of cloth, for example, can be positioned on the apparatus and condensed simultaneously. The hydraulic press includes a press ram which forces the material onto the plurality of pins. The hydraulic press also includes a base area upon which the plurality of plates in the frame are securely fastened. Furthermore, the press includes vacuum ports and steam inlets positioned adjacent the plurality of plates so that the ten layers of cloth can be vacuumed downwardly onto the plurality of plates and then steamed to moisten the cloth making it more pliable. Once the cloth has been contracted, a cheese cutter screen lifts the cloth from the pins in a manner to avoid removing the contraction. A fusing material is secured to the cloth to permanently retain the condensed or contracted portion.

In another embodiment of the present invention, a plurality of pins are vertically oriented on a piece of semioval sponge-like material, or the sponge-like material has a non-uniform, rough surface instead of pins. The semioval, elastic or sponge-like material may be made of polyurethane foam or rubber, for example, and includes a non-stretchable belt around its periphery so that the sponge-like material cannot expand to an area greater than its relaxed condition. A piece of cloth is placed over the semioval sponge-like material and pressed downwardly with a complimentary mating upper surface. The semioval sponge is flattened so that its periphery is condensed, thus condensing the cloth. The cloth is removed and a fusing is employed to maintain the cloth in the condensed state.

In the broadest sense, the apparatus of the present invention includes a means for forming a condensed portion of a piece of cloth, said means condensing said portion more in the central area than at the ends of said portion and means for permanently maintaining the cloth in the condensed form.

In the broadest sense, the method of the present invention comprises placing one or more layers of cloth onto a multitude of vertically oriented pins, pressing the layers of cloth onto the pins, condensing the cloth by contracting the plurality of pins toward one another, removing the condensed cloth from the multitude of pins and securing a backing to each layer of cloth to retain the cloth in the condensed form.

BRIEF DESCRIPTION OF THE DRAWINGS

Other aims and advantages of the invention will become apparent upon reading the following detailed description and upon reference to the drawings, in which.

DETAILED DESCRIPTION OF THE INVENTION

Figure 1:
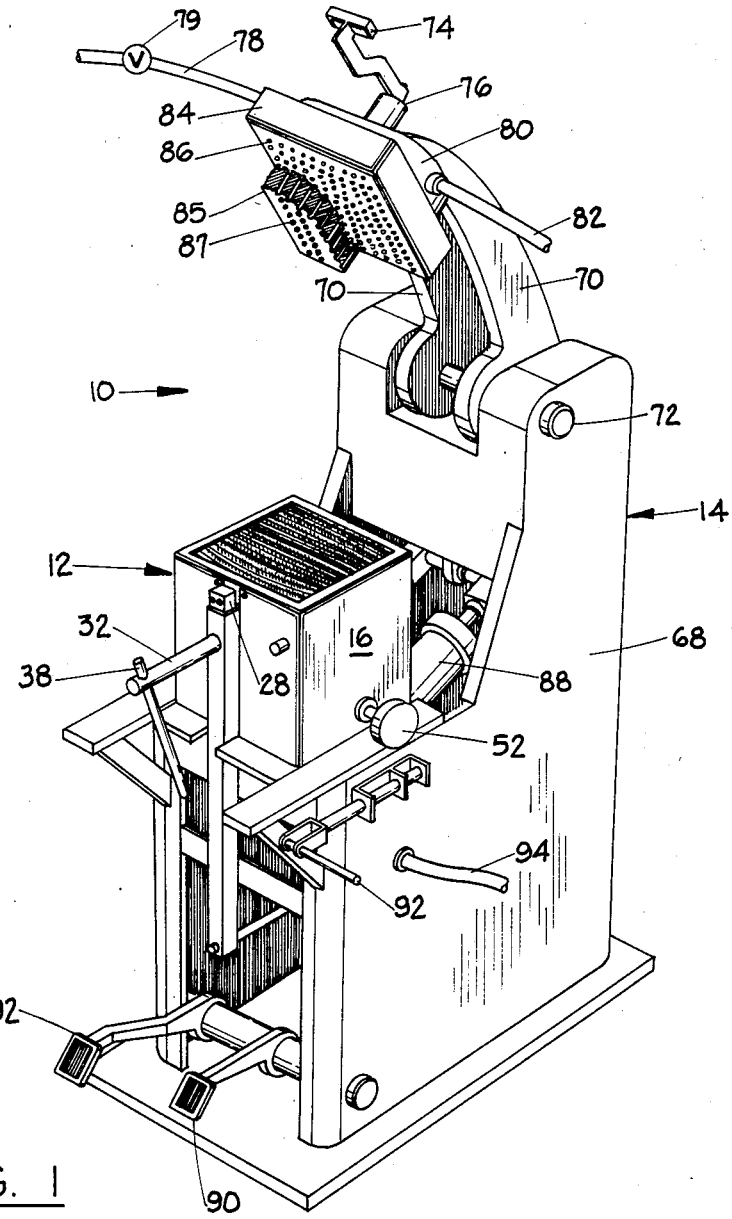
FIG. 1 is a perspective elevational view of the press ram with the cloth condensing unit mounted thereon.

In making articles of clothing, for example, a sportcoat or jacket, a dart or tuck is often necessary to gather in the cloth to achieve a proper fit. Conventionally, a dart was created by cutting a portion of the material out of the garment or folding a portion of the garment and then stitching the ends of the cut or fold to one another, thus gathering in the garment. For example, a person's shoulders and upper chest are normally larger in circumference than the circumference of one's body around the lower rib cage and waist. Consequently, in making a coat or jacket, it would be necessary to gather in the jacket in the area of the lower rib cage or waist so that the jacket properly fits. However, conventional darts or tucks are unbecoming to the eye.

In making a garment, such as a jacket, a plurality of tucks may be necessary, not only in the rib cage area but in the area of the shoulders and waist area of the back. However, forming tucks according to the conventional procedure is both time-consuming and labor intensive. In order to reduce the time to manufacture a jacket and to reduce the labor cost, the present invention forms a condensed area in a garment by gathering the cloth over and area of 8 inches, for example, and condensing it a predetermined amount such as $\frac{1}{4}$-inch, such that the cloth now measures $7\frac{3}{4}$ inches. In effect, a dart or tuck has been created.

While the present invention is designed to replace the conventional method of making a tuck or dart, the present invention also opens a whole new field in garment making. For example, it is well known that the trunk of a jacket has six pieces, namely, right and left front panels, right and left side body panels, and right and left back panels. In cutting each of these pieces, the upper portion is usually cut larger than the lower portion since most people have a large upper torso and a small lower torso. In sewing or joining the six pieces to one another to form a jacket, many errors can occur, and as stated previously, the task is very labor intensive.

With the present invention, a one-piece trunk for a jacket could be cut from a bolt of cloth, for example, and a plurality of contractions could be made, where necessary, to taper the jacket from the upper portion to the lower portion. The result is a jacket having a trunk portion without any tucks or darts or seams which are unbecoming to the eye. Additionally, all the plurality of contractions can be made simultaneously so that the labor intensive process of making a jacket has been reduced to the steps of cutting the one-piece trunk portion and then simultaneously forming a plurality of contractions or condensed areas to properly form the jacket.

From the above description, it is apparent that the present invention: (1) eliminates recognition by the human eye to detect the condensed area from the uncondensed area; (2) eliminates sewing; (3) eliminates human error; (4) reduces pattern making; (b 5) reduces the amount of cutting; (6) reduces the amount of designing; (7) saves piece goods by eliminating seams; (8) increases quality and production; and (9) can form as many as 10 layers of cloth simultaneously, depending on cloth weight; and (10) eliminates target areas especially in the center back area where, due to sewing the back left and right panels together, wide stripes converge causing oval targets to appear.

The preferred device for making an artificial tuck in a piece of cloth is illustrated in FIG. 1, generally represented by reference numeral 10. A cloth condensing unit 12 is mounted upon a hydraulic press 14. The cloth condensing unit, as more clearly illustrated in FIGS. 2–4, comprises a housing or frame 16 having a quadrilateral opening 18 in the top surface thereof. Extending below and across the quadrilateral opening 18 are a pair of support bars 20 securely held by the frame 16. Mounted upon top of the support bars 20 are a plurality of thin vertically oriented plates 22, each plate having a recessed opening 23 along each side edge. Mounted parallel with the support bars 20 are a pair of spaced apart, rectilinear slide bars 25 positioned adjacent opposite sides of the housing or frame 16. The recessed openings 23 fit about the slide bars 25 to support and permit each plate to slide along the slide bars 25. Thus, each plate 22 is supported by a pair of support bars 20 and a pair of slide bars 25. The plates 22 are vertically positioned so that their upper edges are facing the quadrilateral opening 18.

Figure 2:
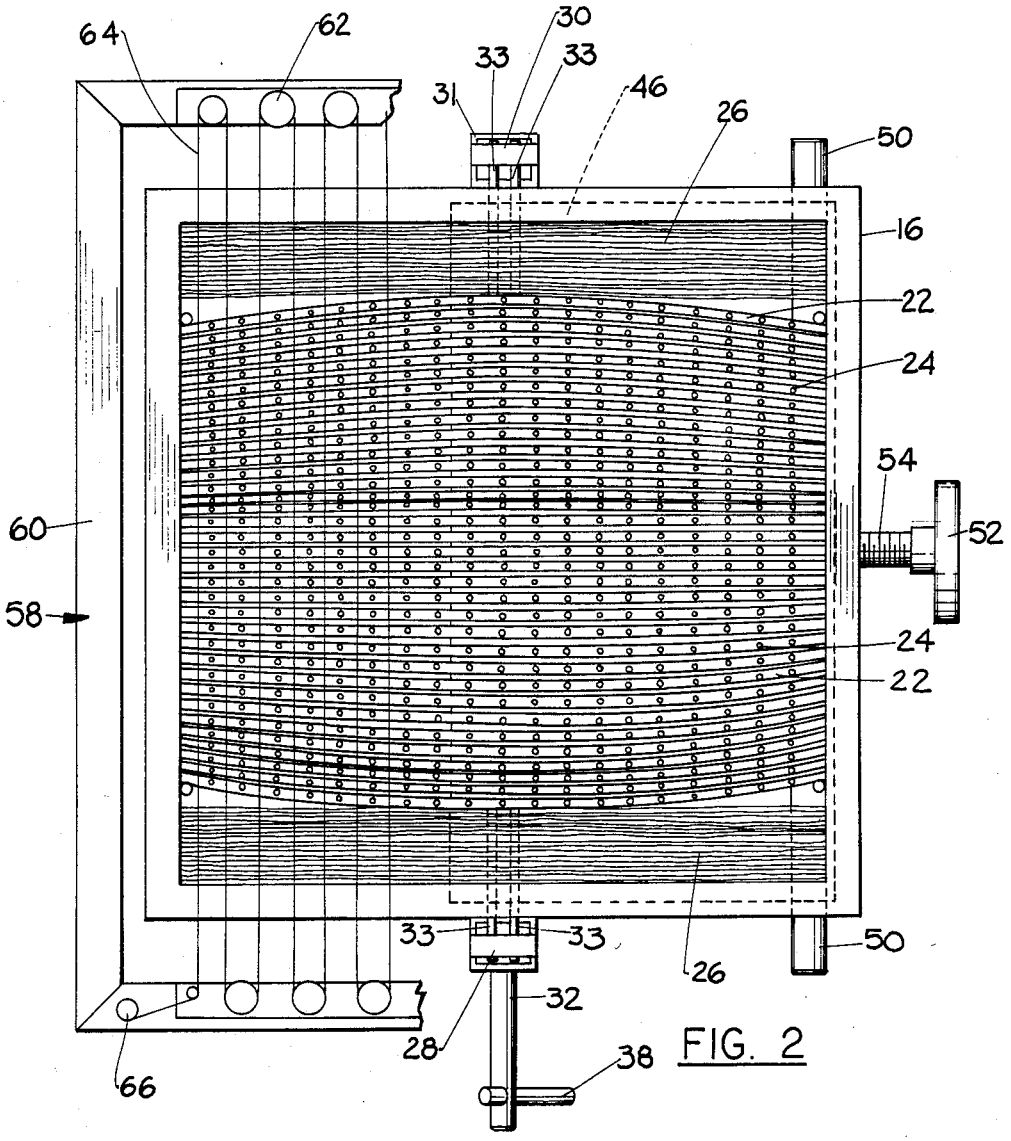
FIG. 2 is an enlarged plan view of the cloth condensing unit.

Each plate 22 includes a plurality of pins 24 which extend vertically upward through the quadrilateral opening 18 and above the top surface of the frame 16. Preferably, the plates 22 located fartherest from the center of the frame 16 are arcuate in shape as shown in FIG. 2. Additionally, the plates 22 positioned near the center of the housing or frame 16 are substantially straight. Those plates 22 extending between the centermost plates and the outermost plates gradually taper from the arcuate shape at the extreme ends to the substantially straight plates near the central portion of the frame. In the relaxed state, the plurality of plates 22 are expanded in the central portion and converge at their ends, having a football-like shape overall. By way of a non-limiting example, there may be 48 plates 22 with the two outermost plates being arced such that there is ½ inch difference between the center of each plate and its ends. The centermost plates 22 may be straight or arced about 0.025 inch between the center and the end of the plates. Each plate is approximately 0.025 inch apart so that the total contraction is approximately 1.25 inches.

Figure 11:
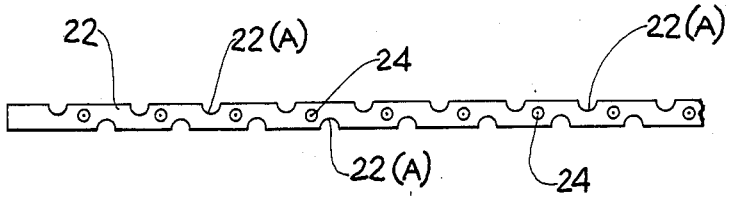
FIG. 11 is a plan view of another embodiment of a pin plate of the present invention.
Figure 4:
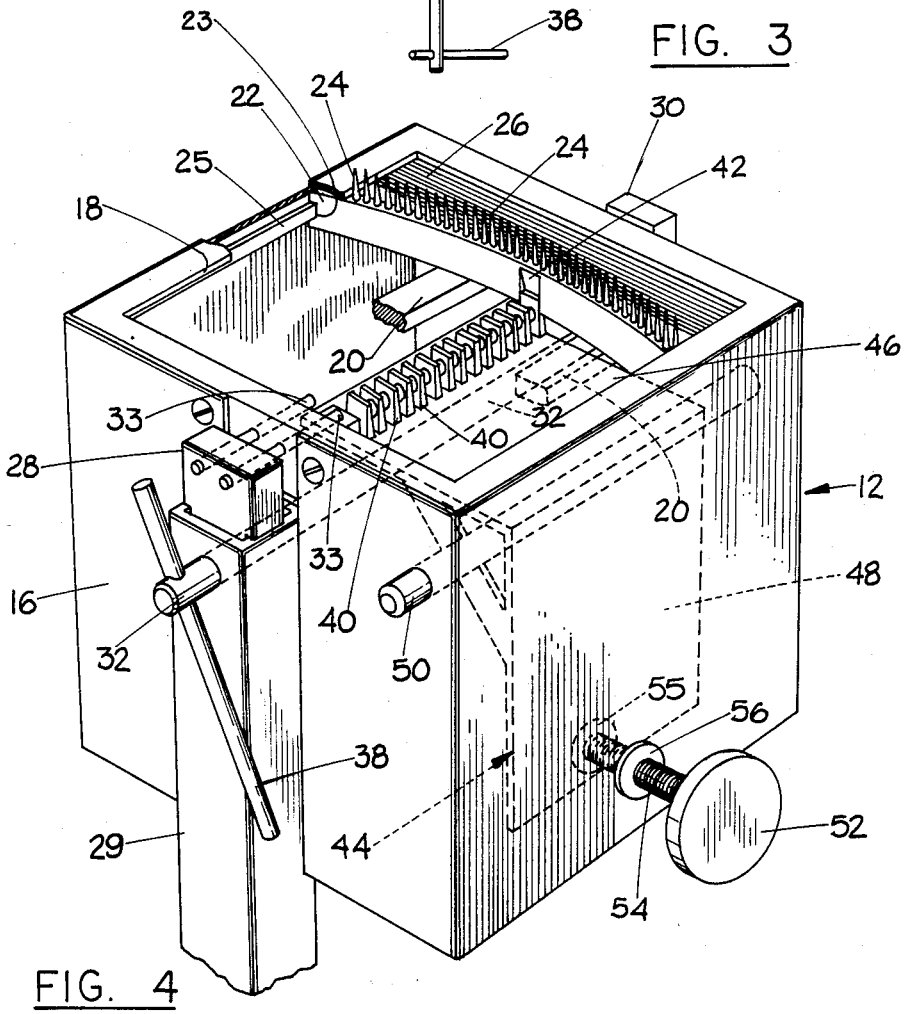
FIG. 4 is an enlarged fragmentary perspective view of the cloth condensing unit, including a thin vertically oriented plate and a plurality of wedges mounted on a wedge plate.

The plates 22 can have a substantially smooth surface on each vertical side, as illustrated in FIG. 4, or alternatively, the plates can have a plurality of verticaly oriented grooves 22(*a*), such as semispherical grooves which may be alternatively positioned on each side of the plate between the pins 24, as illustrated in FIG. 11. The grooves (22(*a*) permit each plate to more easily flex with reduced stress and permit vacuum or steam to easily be drawn through the plates 22, to treat the cloth lying thereon.

The pins 24 may be any shape, however, pins having a very slight taper with a completely rounded point are preferred. Such pins can achieve one of the primary aims of the present invention, i.e., not to destroy the fabric or cloth by cutting or severing the weave of the fibers, but instead, to separate the fibers when penetrating them so that no holes or torn fibers or filaments are visible when the cloth is removed from the pins.

The number of plates 22 employed is directly dependent upon how large an area of the cloth the clothier wishes to condense. For example, if the clothier wishes to condense a large portion of cloth, the cloth condensing unit 12 could include a sufficient number of plates 22 to entirely close off the quadrilateral opening 18. On the other hand, if the cloth condensing area were smaller in size, a number of spring filler plates 26 having no pins extending vertically upward could be mounted or supported in the same manner as plates 22 and positioned at each end of the last arcuate plate 22. The filler plates would prevent any scraps of cloth or other such items from dropping downwardly into the frame 16 and would serve to partially close off the quadrilateral opening 18, so that if a vacuum were drawn through the quadrilateral 18 from below the cloth condensing unit 12, a uniform vacuum would be drawn through all the plates 22 and 26. While it is not necessary to draw a uniform vacuum through the filler plates 26, it is necessary to design the filler plates 26 so that they effectively partially close off most of the area between the last arcuate plate 22 and the end of the frame 16 so that the vacuum does not easily escape and therefore is drawn across the plates 22.

Figure 3:
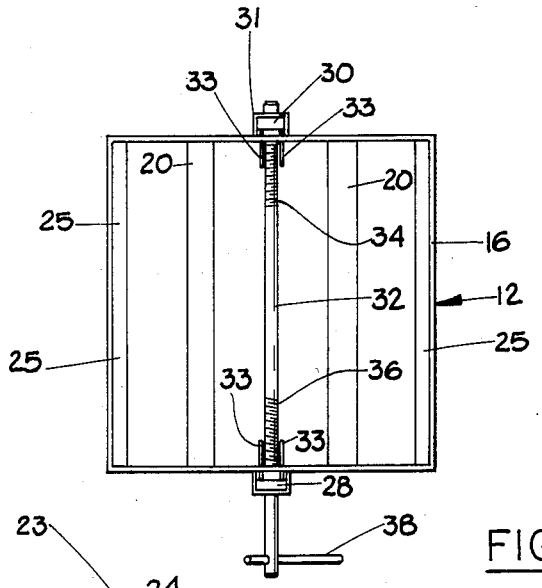
FIG. 3 is a plan view of the clamping means of the cloth condensing unit.
Figure 10:
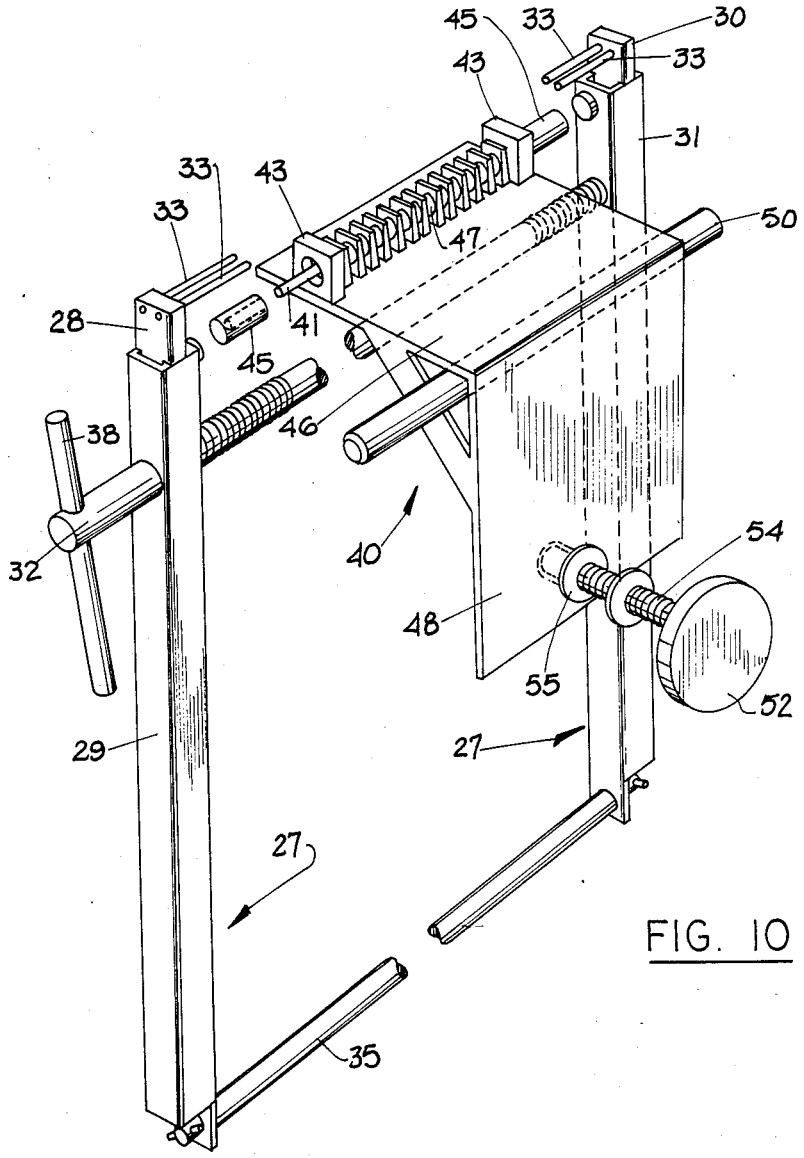
FIG. 10 is a fragmentary perspective view of the wedge system and the vice clamping system.

FIG. 3 shows a plan view of the cloth condensing unit 12 with the plates 22 and 26 omitted to show the additional features of the vice along with support bars 20 and slide bars 25. FIG. 10 also illustrates features of the vice 27. The vice 27 includes at each end of the frame 16 a compression head 28, 30. Each compression head 28 and 30 is mounted within an elongated channel housing 29, 31, respectively. Attached to the compression heads 28 and 30 are push rods 33 which are parallel with support bars 20 and extend to and abut against the outermost plates 22. Preferably, the journal shaft 32 includes oppositely threaded ends 34, 36. Preferably, each compression head 28 and 30 includes a threaded opening which mates with the threads of a shaft 32. Rotation of shaft 32 causes channel housing 29 and 31 to converge together because they are hinged together at their lower ends by means of mandrel 35, as illustrated in FIG. 10. Extending beyond the screw threads 36 and secured to the journaled shaft 32 is a handle 38. When the handle 38 is rotated clockwise, as viewed in FIGS. 3 and 4, the compression heads 28 and 30 advance toward the center of the frame 16 thus advancing push rods 33 toward the center of the frame to compress the plates 22. Conversely, when the handle 38 is rotated counterclockwise, the compression heads 28 and 30 advance to the extreme end position within the elongated U-shaped housing 29, 31, as shown in solid lines in FIG. 3, thereby permitting the plates 22 and 26 to return to their natural relaxed position.

It is now apparent that when it is desired to condense a piece of cloth, the piece of cloth is merely positioned so that the pins 24 penetrate the cloth when the plates 22 are in their fully expanded, relaxed position, that is, when the plates are not under compression from the compression heads 28 and 30. Once the cloth is mounted upon the pins 24, the operator merely turns the handle 38 clockwise thus clamping all the plates 22 and any filler plates 26 toward the center of the frame 16 until the plates are distorted so that all the plates 22 are perfectly straight. In this position, compression heads 28, 30 project into the frame or housing 16, as illustrated in FIG. 4. Due to the arcuate nature of the outer plates 22, the central area of the area of cloth to be condensed is condensed more at the central area than at each end portion. This is desirable so that the condensed cloth gradually fades into and out of the condensed area so that a pleasing overall appearance is given to the garment.

In some instances, it may be desirable to manufacture the cloth condensing unit 12 so that the degree or amount of condensing can be varied. For example, in forming a coat or jacket the amount of condensing to be manufactured into the jacket would depending upon anatomical dimensions of the person wearing the garment. In order to vary the size of the condensed area, a plurality of wedges 40 are vertically oriented so that they taper upwardly toward the quadrilateral opening 18. The wedges 40 are designed to be positioned below the plates 22 when full condensing is desired. On the other hand, when less than full condensing is desired, the wedges can be raised and positioned between each plate 22, so that the plates 22, when compressed by the compression heads 28 and 30 are prevented from being fully compressed. Preferably, each plate 22 includes a wedge groove 42 centrally located in the plate 22 and tapered so that the wedge groove 42 is smallest at its upper end and largest at its lower end.

Positioning the wedges 40 can be done in any conventional manner, such as mechanically, electromechanically, electronically or pneumatically. As illustrated in FIGS. 4 and 10, the wedges 40 are securely mounted on a shaft 41 sized so as to permit the wedges to slide. The shaft 41 is mounted within at least two stationary blocks 43, each block having an opening to receive the shaft 41. In turn, the stationary blocks 43 are fixedly mounted on an angled plate 44. A pair of partially hollow sleeves 45 fit snugly around each free end of the shaft 41 are designed to permit reciprocation of the sleeves 45 on the ends of shaft 41. The stationary blocks 43 permit the sleeve 45 to slide within the opening and around the ends of shaft 45. Thus, sleeves 45 are supported by the stationary blocks 43 and by the shaft 41. The sleeves 45 are elongated so that the ends opposite the shaft 41 abut against or are adjacent to the channel housing 29, 31.

The angled plate 44 includes a horizontal section 46 and a vertical section 48. The angled plate 44 is designed to be rotatably positioned about shaft 50 positioned adjacent the junction of the horizontal portion 46 and the vertical portion 48 and securely mounted within the frame 16. As clearly illustrated in FIGS. 4 and 10, the wedges 40 are mounted near the end of the horizontal portion 46. The vertical adjustment knob 52 includes a threaded shaft 54 extending through a threaded bearing 56 of frame 16. The vertical adjustment knob 52 is positioned so that one end of the shaft 54 contacts the vertical portion of the angle plate 44 near its lower end.

As can be seen from FIG. 4, when the vertical adjustment knob 52 is rotated clockwise, the threaded shaft 54 contacts and bears against a thrust bearing 55 which is secured to vertical portion 48. The angle plate 44 pivots about the shaft 50, forcing the horizontal portion 46 and the wedges 40 upwardly between the plates 22. On the other hand, when the vertically adjusted knob 52 is rotated counterclockwise, the threaded portion 54 backs away from the thrust bearing 55 thus pulling the angle plate 44. When the vertical adjustment knob 52 is backed away from the frame 16 a sufficient distance, the wedges 40 will no longer be in a position to spread the plates 22, i.e., the wedges 40 will remain between the plates 22 but in an inactive position.

As illustrated in FIG. 2, a cheese cutter screen 58 is designed to be positioned over and supported by the cloth condensing unit 12. The cheese cutter screen 58 includes a quadrilateral frame 60 having at opposed sides a plurality of circular pegs 62 about which is wound a continuous wire 64. The tension of the wire 64 can be adjusted by the tension adjustment screw 66. The position of the pegs 62 on frame 60 are such that they are in alignment with a row of pins 24. In this manner, the wire 64 extends between each row of pins 24 and supports the cheese cutter screen 58 by virtue of the fact that the wire 64 rests upon the housing or frame 16 and to some extent the wire may rest upon the plates 22. The cheese cutter screen 58 permits the condensed cloth to be removed from the cloth condensing unit 12 without destroying the condensed portion.

The cloth condensing unit 12 can be operated manually, however, preferably the cloth condensing unit 12 is positioned upon a press 14, as illustrated in FIG. 1, so that the operation can be conducted hydraulically, electrically, pneumatically or mechanically. The press 14 includes a base portion 68 upon which is mounted the cloth condensing unit 12. The press also includes a pair of pivotal arms 70 which rotate about a mandrel 72 securely fastened to the base 68 of the press 14. Attached to the outer pair of arms 70 is a steam handle 74 which actuates or opens a steam valve 76. The steam valve 76 connects the steam chamber 80 to the manifold 84, each of which are securely fastened to the outer ends of the arms 70. The steam chamber 80 is fluidly connected to a steam line 82 which in turn is coupled to a source of steam (not shown). Attached to the manifold 84 is a vacuum line 78 with a vacuum valve 79 to permit coupling or uncoupling the vacuum source (not shown) to the manifold 84. The manifold 84 includes a plurality of openings 86 therein for drawing a vacuum or emitting steam from the manifold 84. Affixed to the manifold 84 is a rubber pad 85 having a plurality of preformed holes 87 in alignment with openings 86. The rubber pad 85 is necessary to prevent the pins 24 from being crushed or broken during use.

A hydraulic cylinder 88 is affixed to the base 68 of the press 14 and is designed to pivot the arms 70 about the mandrel 72 to cause the manifold 84 to drop downwardly immediately above and over the cloth condensing unit 12. The hydraulic cylinder 88 is controlled by any means such as foot pedal 90 positioned in front of the press 14 and below the cloth condensing unit 12. A release handle 92 is secured to the side of the base 68 of the press 14 and serves to actuate a hydraulic valve (not shown) that raises the manifold 84 by causing the arms 70 to pivot upwardly about the mandrel 72. A vacuum source 94 is connected to the cloth condensing unit 12 near the bottom thereof so as to draw a vacuum therethrough by means of a vacuum source (not shown). The vacuum can be controlled by foot pedal 92 positioned in front of press 14 and adjacent to foot pedal 90.

Figure 5:
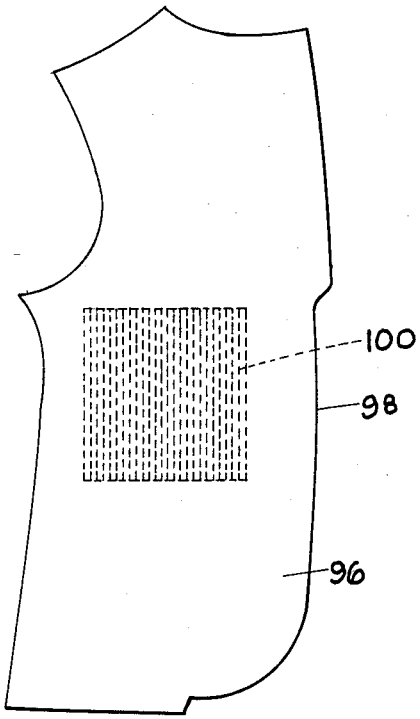
FIG. 5 is a front view of the right hand panel of a sportjacket.
Figure 6:
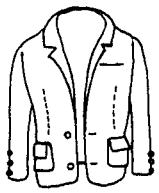
FIG. 6 is a front view of a sportcoat or jacket having a condensed dart or tuck positioned in each rib cage area.

In operation, a plurality of layers of cloth, for example ten layers shaped similarly to the layer of cloth illustrated in FIG. 5 (the front right-hand panel of a jacket) are oriented so that the front edge 98 of the cloth 96 faces compression head 28 of the cloth condensing unit 12. In this manner, the condensing area to be formed in area 100 as illustrated in FIG. 5, is positioned immediately over the cloth condensing unit 12. The layers of cloth are positioned upon the cloth condensing unit 12 only when the plurality of plates 22 are in their relaxed, undistorted conditions and when no steam or vacuum line is operational. The manifold 84 is then caused to pivot down upon the layers of cloth by activating foot pedal 90 which activates hydraulic cylinder 88 as previously disclosed. Once the manifold rests lightly upon the layers of cloth, the layers of cloth are steamed by pushing down upon steam valve handle 74 to allow steam to enter the manifold 84 from the steam chamber 80. Additionally, the vacuum source positioned below the cloth condensing unit 12 is activated through the vacuum line 94 by means of the foot pedal 92. In this manner, the steam exiting through the orifices 87 of the rubber pad 85 is drawn through the cloth and through the cloth condensing unit 12 to the vacuum source by the vacuum line 94. If the preferred plates 22 are employed having the plurality of grooves 22(*a*), as illustrated in FIG. 11, the grooves aid in drawing the steam uniformly through the layers of cloth. This assures that all the layers of cloth are adequately steamed so as to relax the fabric of the cloth.

Once the fabric has been steamed, the manifold 84 may be continually lowered so that it compresses the layers of cloth 96 in such a manner that the pins 24 penetrate between the filaments or threads of the fabric for each layer. During the compression step, steam may optionally be employed and the vacuum positioned below the cloth condensing unit 12 may be optionally engaged.

Once all of the layers of cloth 96 have been compressed and the pins forced through the cloth, the manifold 84 is raised by engaging the reversing handle 92 as previously described. During the reversing operation, no steam is employed and preferably the vacuum positioned below the cloth condensing unit 12 is also disengaged. The operator then rotates the vertical adjustment knob 52 to position the wedges 40 between the plates 22 to the desired height in order to achieve the degree of condensing desired. Next, the operator rotates handle 38 clockwise causing the compression heads 28, 30 to advance toward one another and compress the plates 22 into a tight pack. Movement of the compression heads 28, 30 toward one another also causes the sleeves 45 to slide further around the ends of shaft 41, through the stationary blocks 43 until the sleeves 45 contact the outermost wedge 40. Further compression of the heads 28, 30 pushes the wedges progressively toward the center, simultaneously with the plates 22. The needles 24 have now condensed the cloth 96, i.e., the cloth is now imperceptively bunched together in a condensed fashion.

Once again, the manifold 84 is lowered by means of hydraulic cylinder 88 and foot pedal 90 until it firmly contacts the top layer of cloth 96. The vacuum line 78 is then actuated by opening valve 79 so that a vacuum is drawn through manifold 84 and through rubber pad 85 by means of the holes 87. Foot pedal 90 is now released and reversing handle 92 is engaged causing the arms 70 to lift the manifold 84 upwardly off the cloth condensing unit 12. The cheese cutter screen 58 is manually lifted upwardly with the layers of cloth thus preventing the cloth from becoming uncondensed. Once all the layers of cloth are lifted off the pins 24 and off the cloth condensing unit 12, the cheese cutter screen 58 lightly drops back down onto the cloth condensing unit 12 into its proper position.

Once the manifold 84 is sufficiently raised above the cloth condensing unit 12 and the cheese cutter screen 58 has dropped downwardly, the vacuum valve 79 can be engaged to block the vacuum source thus dropping the layers of cloth into the arms of the waiting operator. Next, each layer of cloth 96 has a fusing applied to the condensed area by manual operation or by a shaping press (not shown) to maintain the cloth in the condensed form. The fusing can be any known conventional fusing. Preferably, however, the fusing is an adhesive fusing which can be positioned upon each layer of cloth and activated so that it adheres to the fibers of the cloth locking them into the desired form.

Once the layers of cloth have been removed from the cloth condensing unit 12, the handle 38 of vice 27 is rotated counterclockwise to permit the plates 22 to return to their relaxed position. As the plates 22 return to their relaxed position, they progressively slide the wedges 40 along shaft 41 to their original position or spacing. The cloth condensing unit 12 is now ready for the next layers of cloth.

It is important to distinguish between the function of plates 26 and the wedges 40. The plates 26 are only used to determine the area of the layer of cloth to be condensed. For example, a small jacket has a small area 100 to be condensed. Contrarily, a large jacket can be condensed over a greater area. A fusing 101, as illustrated in FIG. 5, maintains the dart or tuck in position.

The wedges 40, on the other hand, determine the amount of condensing to be conducted within the area 100 as illustrated in FIG. 5. The wedges can condense a jacket, for example, a $\frac{3}{4}$ inch for each layer, or perhaps adjust a 1/16 of an inch for each layer. Consequently, in order to manufacture the perfect garment, both the number of plates 22 and the position of the wedges 40 must be determined in accordance with conventional clothing design.

Another optional feature of this embodiment is that the wedges 40 could be positioned off-center. In other words, while the wedges 40 would still be positioned in a broad central region with respect to the plates 22, the wedges do not necessarily have to be positioned at the center of each plate 22. In this manner, a non-symmetrical condensed area could be formed when it is desired for the condensed area to taper sharply from one side and then gradually taper to the opposite side.

Another optional feature of this embodiment relates to the fact that the condensed area 100 of each layer of cloth 96 could be pulled from one direction only. For example, shaft 32, illustrated in FIGS. 3 and 4 could include threads 36 and omit threads 34 so that when handle 38 is rotated clockwise, the plates 22 are compressed toward the rear of the condensing unit 12. This feature may be employed where it is desired to accentuate an anatomical portion of the wearer, particularly when the cloth includes a design, such as stripes, which cold produce the necessary visual emphasis.

Figure 8:
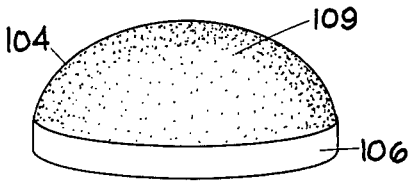
FIG. 8 is a perspective view of another embodiment of the present invention illustrating a semioval sponge-like material having a non-uniform rough exterior surface.
Figure 7:
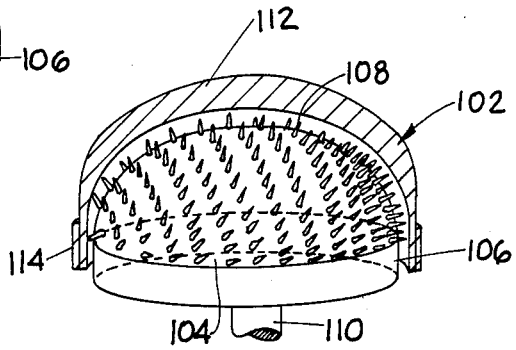
FIG. 7 is a perspective view of another embodiment of the present invention illustrating a semioval sponge-like material with a plurality of pins for condensing the cloth.

Another embodiment of the present invention is illustrated in FIG. 7. A cloth condensing unit, generally represented by reference numeral 102 comprises a sponge-like semioval material 104 formed from rubber having a durometer of 50–80, for example. A non-stretchable belt 106, preferably made of metal, surrounds the largest periphery of the semioval sponge-like material 104. A plurality of pins 108 are firmly secured to the exterior surface of the sponge-like material 104. The pins 108 are much smaller than pins 24. Rather than employing pins 108, the exterior surface of the semioval 104 could be roughened. For example, the exterior surface could be impregnated with fine emery 109 as shown in FIG. 8. The rough surface would prevent the cloth from slipping. Molded within the rubber semioval 104 and projecting from the bottom thereof is a mandrel 110 which will retain the semioval 104 in a collapsed condition after it has been initially collapsed. Associated with the semioval 104 is a complementary bowl-shaped head 112 made from the same rubber material.

On the outerk periphery of head 112 is a metallic belt 114 slightly larger in semioval diameter than belt 106.

In operation, when the sponge-like material 104 is in its relaxed condition, not more than 2 layers of cloth are positioned over the cloth condensing unit 102. Then, the head 112 is lowered upon the cloth condensing unit 102. As downward force is placed upon head 112 and unit 102, the layers of cloth 96 upon the cloth condensing unit 102 are simultaneously condensed by flattening the semioval sponge-like material 104 down into the belt 106, and by flattening the head 112 down into belt 114. By craming the sponge-like material 104 into the periphery of the belt 106, the pins 108 are brought closer toward one another, thus condensing the cloth in the desired manner.

Once the cloth has been condensed, the mandrel 110 can be locked or held into place to maintain the semioval 104 in the condensed, flattened state. The head 112 may then be removed or the semioval 104 may be lowered from beneath the collapsed head 112. The exposed condensed cloth can now be removed and a fusing can be secured thereto by means of a shaping press.

Figure 9:
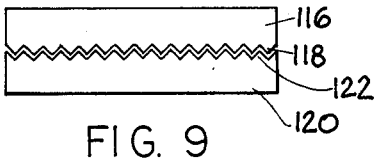
FIG. 9 is a cross-sectional side view of another embodiment of the present invention showing a toip and bottom member 7, each having a plurality of teeth.

FIG. 9 illustrates another embodiment of the present invention. The condensing unit includes a top member 116 having a plurality of peaks, ridges, or teeth 118. A corresponding bottom member 120 also includes a plurality of complementary peaks, ridges or teeth 122.

When one or more layers of cloth are positioned between the top member 116 and the bottom member 120, and the members are brought together, the cloth becomes condensed. After the cloth is condensed, a fusing can be applied at a shaping press to retain the condensed form of the cloth.

Further modification of the invention can be made without departing from the spirit of it. For example, rather than employing a semioval sponge-like material, a hollow semioval balloon-type material could be employed which would include a plurality of pins or rough surface vertically mounted on the surface thereof. Once the layers of cloth are positioned upon the balloon-like material, the head of a press could deflate the balloon material by driving the air therefrom. Once the balloon has fully collapsed, the cloth would be condensed. The layers of condensed cloth can now be removed from the collapsed balloon unit.

What is claimed is:

1. A device for forming a condensed area in a portion of cloth comprising:

engaging means (a) containing a plurality of adjacent rows of pins in a field wherein at least one row in the center of said field is substantially straight and the outermost rows on either side of said at least one center row is bowed away from said at least one center row and those rows between said at least one center row and said outermost rows are bowed in progressively greater arcs between that of said at least one center row and that of said outermost rows in the first position; and condensing means (b) comprising means for condensing said adjacent rows of pins into a second position wherein said adjacent rows are closer together and are substantially parallel in said field.

2. The device according to claim 1, wherein said engaging means (a) comprises a plurality of thin, vertically oriented plates, said pins being mounted vertically on said plates, and a slide bar, said plates mounted on said slide bar so that said plates can shift from said first position to said second position.

3. The device according to claim 2, further including a plurality of vertically tapering, vertically positioned wedges, and a means to vertically position said wedges from a disengaged position beneath each out of the plane of said plates to an engaged position between each in the plane of said plates to vary the spacing of said pins in said second position.

4. The device claimed in claim 1, further including a screen, said screen having a wire, said wire sized to fit between adjacent said pins.

5. The device according to claim 1 wherein said engaging means also includes securing means for forcing said portion of cloth onto said pins and maintaining said portion of cloth on said pins during condensing.

6. A device according to claim 5, wherein said securing means is a rubber pad having a plurality of preformed holes.

7. A device for forming a condensed area in a portion of cloth comprising engaging means (a) comprising a semi-oval piece of elastic material having on its exterior surface means for mutably engaging a portion of cloth in a first position; and cloth condensing means (b) comprising means for deforming said semi-oval piece and said portion of cloth engaged thereby into a second position whereby said portion of cloth is condensed towards its center, is smooth and uniform on its surface, and contains no pleats, tucks, folds, puffing, darts or undulations.

8. The device according to claim 7, wherein said said semi-oval elastic piece has an exterior surface which is sufficiently rough to mutatably engage said portion of cloth.

9. The device claimed in claim 8, wherein said exterior surface is impregnated with fine emery.

* * * * *